US009970133B2

(12) United States Patent
Ukuma et al.

(10) Patent No.: US 9,970,133 B2
(45) Date of Patent: May 15, 2018

(54) WOVEN FABRIC AND GARMENT

(75) Inventors: Akio Ukuma, Osaka (JP); Kenji Iwashita, Osaka (JP)

(73) Assignee: TEIJIN FRONTIER CO., LTD., Osaka (JP)

( * ) Notice: Subject to any disclaimer, the term of this patent is extended or adjusted under 35 U.S.C. 154(b) by 146 days.

(21) Appl. No.: 13/823,558

(22) PCT Filed: Nov. 14, 2011

(86) PCT No.: PCT/JP2011/076138

§ 371 (c)(1),
(2), (4) Date: Mar. 14, 2013

(87) PCT Pub. No.: WO2012/067053

PCT Pub. Date: May 24, 2012

(65) Prior Publication Data

US 2013/0177753 A1 Jul. 11, 2013

(30) Foreign Application Priority Data

Nov. 18, 2010 (JP) ..... 2010-257930

(51) Int. Cl.
*D03D 15/00* (2006.01)
*D03D 1/00* (2006.01)
(Continued)

(52) U.S. Cl.
CPC ..... *D03D 15/00* (2013.01); *A41D 27/00* (2013.01); *D03D 1/00* (2013.01); *D03D 13/008* (2013.01);
(Continued)

(58) Field of Classification Search
CPC .... D03D 15/00; D03D 15/0061; D03D 15/77; D10B 2331/04; D10B 2401/021; D01B 2501/04
USPC ... 59/243, 244, 245, 246, 247, 24, 250, 258, 59/259, 260; 442/59, 60, 79, 82, 85, 86, 442/88, 92, 94, 97, 98, 101–107, 164, 442/181, 182, 189, 203, 208, 209, 213, 442/216, 218, 220; 428/212, 213, 219,
(Continued)

(56) References Cited

U.S. PATENT DOCUMENTS 5,637,385 A * 6/1997 Mizuki ..... B60R 21/235 280/728.1
6,607,995 B1 8/2003 Takeuchi et al.
(Continued)

FOREIGN PATENT DOCUMENTS

JP 4-5786 B2 2/1992
JP 08284067 A * 10/1996
(Continued)

OTHER PUBLICATIONS

Machine Translation of JP 2010-156064 Dec. 11, 2014.*
(Continued)

*Primary Examiner* — Frank J Vineis
(74) *Attorney, Agent, or Firm* — Sughrue Mion, PLLC

(57) ABSTRACT

Provided are a woven fabric having excellent lightweightness and water resistance and a garment using the woven fabric. The woven fabric has an areal weight of 100 g/m$^2$ or less and a cover factor of 1,800 or more. One of the warp and weft of the woven fabric contains a false-twist crimped yarn, and the other contains a non-crimped yarn.

7 Claims, 1 Drawing Sheet

(51) Int. Cl.
*D03D 13/00* (2006.01)
*A41D 27/00* (2006.01)

(52) U.S. Cl.
CPC ..... *D03D 15/0061* (2013.01); *D03D 15/0077* (2013.01); *D10B 2331/04* (2013.01); *D10B 2401/021* (2013.01); *D10B 2501/04* (2013.01)

(58) Field of Classification Search
USPC ..... 428/220, 332, 337, 340, 362, 369, 375, 428/392, 394, 395, 397, 400, 401
See application file for complete search history.

(56) References Cited

U.S. PATENT DOCUMENTS

| | | | | |
|---|---|---|---|---|
| 2008/0085398 | A1* | 4/2008 | Yasui | A41B 17/00 428/152 |
| 2014/0035294 | A1* | 2/2014 | Promutico | D06F 37/42 292/98 |

FOREIGN PATENT DOCUMENTS

| | | | | |
|---|---|---|---|---|
| JP | 09170175 | A | * | 6/1997 |
| JP | 3034045 | B2 | | 4/2000 |
| JP | 2001-055644 | A | | 2/2001 |
| JP | 3133227 | B2 | | 2/2001 |
| JP | 2004-44018 | A | | 2/2004 |
| JP | 2004-211268 | A | | 7/2004 |
| JP | 2004-270097 | A | | 9/2004 |
| JP | 2005-240265 | A | | 9/2005 |
| JP | 2009-91694 | A | | 4/2009 |
| JP | 2009-138287 | A | | 6/2009 |
| JP | 2010-156064 | A | | 7/2010 |
| JP | 2010-196213 | A | | 9/2010 |
| TW | I222473 | B | | 10/2004 |
| TW | 200624614 | A | | 7/2006 |
| WO | 2008/056406 | A1 | | 5/2008 |

OTHER PUBLICATIONS

Machine Translation of JP 2009-138287 Dec. 13, 2014.*
Singha, Fiber Crimp Distribution in Nonwoven Structure, Frontiers in Science 2013, 3(1): 14-21.*
Kadolph, S., Textiles, 2002, Pearson Education, Inc., Ch. 10, Yarn Processing.*
Hall, M. Finishing of Technical Textiles. In Handbook of Technical Textiles (1st ed.), pp. 152-157. 2000. Woodhead Publishing Limited.*
Search Report, dated Mar. 25, 2014, issued by the European Patent Office, in counterpart Application No. 11840743.6.
Communication, dated Apr. 4, 2014, issued by the European Patent Office, in counterpart Application No. 11840743.6.
International Search Report of PCT/JP2011/076138, dated Jan. 31, 2012.
Office Action issued by the Korean Patent Office dated Nov. 17, 2017, for counterpart Application No. 10-2013-7015561; 9 pages including machine translation.

* cited by examiner

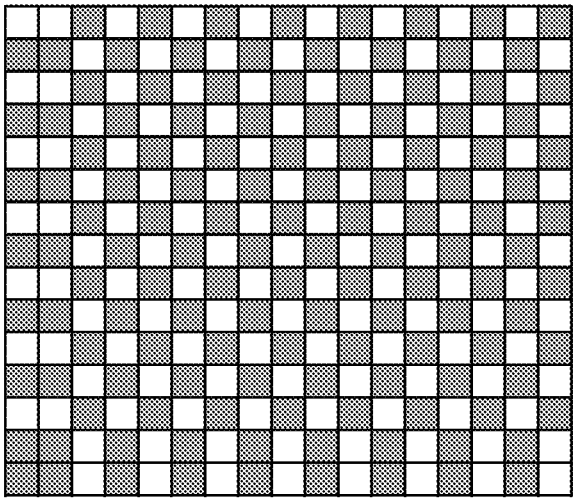

WOVEN FABRIC AND GARMENT

CROSS REFERENCE TO RELATED APPLICATIONS

This is a National Stage of International Application No. PCT/JP2011/076138 filed Nov. 14, 2011, the contents of which are incorporated herein by reference in their entirety.

TECHNICAL FIELD

The present invention relates to a woven fabric having excellent lightweightness and water resistance and also to a garment using the woven fabric.

BACKGROUND ART

Conventionally, water-resistant woven fabrics have been widely used for applications to sport garments, general garments, bedding covers, etc. Especially for sport garments, with the spread of outdoor sports, etc., woven fabrics having improved water resistance have been demanded. In order to meet such demands, a method that reduces the single-fiber fineness of fibers forming a woven fabric, a method that increases the density of a woven fabric, and the like have been proposed (see, e.g., Patent Document 1, Patent Document 2, and Patent Document 3). In addition, for these applications, not only water resistance but also lightweightness (low areal weight) has been demanded.

However, water resistance and lightweightness are usually conflicting properties. For example, there is a problem in that an increase in areal weight to improve water resistance impairs lightweightness, while, conversely, a decrease in areal weight to improve lightweightness impairs water resistance.

Patent Document 1: JP-A-2004-44018
Patent Document 2: JP-A-2005-240265
Patent Document 3: Japanese Patent No. 3034045

DISCLOSURE OF THE INVENTION

Problems that the Invention is to Solve

The invention has been accomplished in view of the above background. An object of the invention is to provide a woven fabric having excellent lightweightness and water resistance and a garment using the woven fabric.

Means for Solving the Problems

The present inventors have conducted extensive research to achieve the above object. As a result, they have found that when one of the warp and weft of a woven fabric contains a false-twist crimped yarn, and the other contains a non-crimped yarn, due to the synergetic effect of the swelling of the false-twist crimped yarn and the binding force of the non-crimped yarn that binds the false-twist crimped yarn, a woven fabric having excellent lightweightness and water resistance is obtained. The present inventors have further conducted extensive research and accomplished the invention.

Thus, the invention provides "a woven fabric having an areal weight of 100 g/m$^2$ or less and a cover factor of 1,800 or more, characterized in that one of the warp and weft of the woven fabric contains a false-twist crimped yarn, and the other contains a non-crimped yarn".

In this case, it is preferable that at least one of the false-twist crimped yarn and the non-crimped yarn has a total fineness of 10 to 50 dtex. It is also preferable that at least one of the false-twist crimped yarn and the non-crimped yarn has 48 or more filaments, and that the total fineness of the false-twist crimped yarn is equal to or higher than the total fineness of the non-crimped yarn. It is also preferable that at least one of the false-twist crimped yarn and the non-crimped yarn is made of a polyester fiber. It is also preferable that the woven fabric contains the false-twist crimped yarn as one component of a composite yarn. It is also preferable that the composite yarn has a torque of 50 T/m or less. It is also preferable that the woven fabric has been subjected to water-repellent processing or calendering. It is also preferable that the thickness of the woven fabric is 0.1 mm or less. It is also preferable that the water-pressure resistance of the woven fabric is 800 mm or more. In this case, it is preferable that the water-pressure resistance retention after 20 washes of the woven fabric is 70% or more.

The invention also provides a garment using the woven fabric.

Advantage of the Invention

According to the invention, a woven fabric having excellent lightweightness and water resistance and a garment using the woven fabric are obtained.

BRIEF DESCRIPTION OF THE DRAWINGS

FIG. 1 shows the weave pattern used in Example 1.

BEST MODE FOR CARRYING OUT THE INVENTION

Hereinafter, embodiments of the invention will be described in detail.

First, it is important that the woven fabric of the invention has an areal weight of 100 g/m$^2$ or less (more preferably 50 to 100 g/m$^2$, particularly preferably 70 to 100 g/m$^2$). When the areal weight is more than 100 g/m$^2$, lightweightness is impaired, and this is thus undesirable.

In addition, it is important that the woven fabric of the invention has a cover factor of 1,800 or more (more preferably 1,800 to 3,500, particularly preferably 2,000 to 2,400). When the cover factor is less than 1,800, sufficient water-pressure resistance is not obtained, and this is thus undesirable. Incidentally, cover factor is defined by the following equation CF:

$$CF=(DWp/1.1)^{1/2}\times MWp+(DWf/1.1)^{1/2}\times MWf$$

wherein DWp is the total fineness of the warp (dtex), MWp is the weaving density of the warp (yarns/2.54 cm), DWf is the total fineness of the weft (dtex), and MWf is the weaving density of the weft (yarns/2.54 cm).

In addition, in the woven fabric of the invention, in terms of lightweightness, it is preferable that the woven fabric has a thickness of 0.1 mm or less (more preferably 0.05 mm to 0.1 mm).

As the false-twist crimped yarn used in the invention, a false-twist crimped yarn having a crimp degree of 5 to 35% is preferable. In the case where the crimp degree is less than 5%, the swelling of the false-twist crimped yarn may be insufficient, whereby sufficient water-pressure resistance may not be obtained. False-twist crimped yarns include a so-called one-heater false-twist crimped yarn obtained by setting a false twist in a first heater zone and a so-called second-heater false-twist crimped yarn obtained by further introducing the yarn into a second heater zone and subjecting the same to a relaxation heat treatment to reduce the torque. In addition, depending on the direction of twisting, false-twist crimped yarns also include a false-twist crimped yarn having a torque in the S-direction and a false-twist crimped yarn having a torque in the Z-direction. These false-twist crimped yarns can be advantageously used in the invention.

In addition, it is preferable that the woven fabric contains the false-twist crimped yarn as one component of a composite yarn. In particular, when the composite yarn has a torque of 50 T/m or less, this provides the woven fabric with a flat surface having excellent snagging resistance and thus is preferable.

Incidentally, torque is measured by the following method. That is, a sample (composite yarn) about 70 cm long is transversely tensioned. An initial load of 0.18 mN×indicated tex (2 mg/de) is hung in the center, and then both ends are put together. The sample starts rotating due to residual torque. The sample is kept as it is until the rotation stops, whereby a twisted yarn is obtained. A load of 17.64 mN×indicated tex (0.2 g/de) is applied to the twisted yarn, and the number of twists in a length of 25 cm is measured by a twist counter. The obtained number of twists (T/25 cm) is multiplied by 4 to determine the torque (T/m).

A composite yarn having a torque of 50 T/m or less as mentioned above can be produced by the following method. First, it is possible to obtain a one-heater false-twist crimped yarn by twisting a yarn using a twisting machine through a first roller and a heat treatment heater set at a temperature of 90 to 220° C. (more preferably 100 to 190° C.). Alternatively, as necessary, it is also possible to obtain a second-heater false-twist crimped yarn by further introducing the yarn into a second heater zone to perform a relaxation heat treatment.

In this case, it is preferable that the draw ratio during false-twist texturing is within a range of 0.8 to 1.5. In addition, it is preferable that $\alpha$ in the following equation is 0.5 to 1.5 (particularly preferably 0.8 to 1.2) : the number of false twists $(T/m)=(32{,}500/(Dtex)^{1/2})\times\alpha$, wherein Dtex is the total fineness of the yarn (dtex). As a twisting machine, it is preferable to use a disc-type or belt-type friction twisting machine because it allows for easy threading and hardly causes yarn breakage. It is also possible to use a pin-type twisting machine. In addition, depending on the direction of twisting, the torque of the false-twist crimped yarn can be selected from the S-direction and the Z-direction.

Next, by combining a false-twist crimped yarn having a torque in the S-direction and a false-twist crimped yarn having a torque in the Z-direction, a composite yarn having a torque of 50 T/m or less is obtained. It is preferable that the composite yarn is interlaced by interlacing processing. In order not to deteriorate the soft texture or stretchability, it is preferable that the number of nodes (interlacing) is within a range of 30 to 90/m. Incidentally, the interlacing treatment (interlacing processing) may be a treatment using an ordinary interlacing nozzle. In addition, the number of nodes (interlacing) is measured by the following method.

That is, an interlaced yarn 1 m long is taken under a load of 8.82 mN×indicated tex (0.1 g/de). The load is removed, and then the yarn is allowed to crimp at room temperature for 24 hours. After that, the number of nodes is read and indicated as the number of nodes/m.

It is preferable that the false-twist crimped yarn used in the invention has a total fineness of 10 to 100 dtex (more preferably 10 to 50 dtex, still more preferably 10 to 48 dtex, particularly preferably 41 to 48 dtex). When the total fineness is less than 10 dtex, the water-pressure resistance of the woven fabric may decrease. Conversely, when the total fineness is more than 100 dtex, lightweightness (low areal weight) may be impaired.

In addition, it is preferable that the number of filaments in the false-twist crimped yarn is 48 or more (more preferably 48 to 10,000, still more preferably 48 to 200, particularly preferably 120 to 200). In the case where the number of filaments in the false-twist crimped yarn is less than 48, the water-pressure resistance of the woven fabric may decrease.

In addition, it is preferable that the false-twist crimped yarn has a single-yarn fineness of 0.5 dtex or less (more preferably 0.001 to 0.5 dtex). Ultrafine fibers having a single-yarn fiber diameter of 1 μm or less, which are called nanofibers, may also be used. In the case where the false-twist crimped yarn has a single-yarn fineness of more than 0.5 dtex, the water-pressure resistance of the woven fabric may decrease.

The single-fiber cross-sectional shape of the false-twist crimped yarn is not limited and may be a known cross-sectional shape, such as round, triangular, flat, or hollow, for example.

The kind of fiber that forms the false-twist crimped yarn is not limited. However, in order to obtain a woven fabric having excellent water-pressure resistance, polyester fibers are preferable. Preferred examples of polyesters forming such polyester fibers include polyethylene terephthalate, polytrimethylene terephthalate, polybutylene terephthalate, polylactic acid, stereocomplex polylactic acid, and polyesters copolymerized with a third component. The polyester may also be a polyester obtained by material recycling or chemical recycling or polyethylene terephthalate obtained using a monomer component produced from a biomass raw material, that is, a substance of biological origin, as described in JP-A-2009-091694. Further, it may also be a polyester obtained using a catalyst containing a specific phosphorus compound or titanium compound as described in JP-A-2004-270097 or JP-A-2004-211268. The polyester may also contain one or more kinds of delusterants (titanium dioxide), micropore-forming agents, cationic dye dyeable agents, coloring inhibitors, heat stabilizers, fluorescent brighteners, colorants, moisture absorbents, and inorganic fine particles.

Next, the non-crimped yarn used in the invention is a yarn having a crimp degree of 3% or less (most preferably 0%). In the case where the woven fabric does not contain the non-crimped yarn, the binding force at the weave points (intersections of warp and weft) in the woven fabric structure may decrease, leading to a decrease in the water-pressure resistance of the woven fabric. Therefore, this is undesirable.

The fiber form of the non-crimped yarn may be a multifilament (long fiber) or a spun yarn (short fiber). However, in order to obtain excellent water-pressure resistance, a multifilament (long fiber) is preferable.

It is preferable that the non-crimped yarn has a total fineness of 10 to 100 dtex (more preferably 10 to 50 dtex, still more preferably 10 to 48 dtex, particularly preferably 10 to 24 dtex). When the total fineness is less than 10 dtex, the water-pressure resistance of the woven fabric may be impaired. Conversely, when the total fineness is more than 100 dtex, lightweightness (low areal weight) may not be obtained.

In addition, it is preferable that the number of filaments in the non-crimped yarn is 48 or more (more preferably 48 to 10,000, still more preferably 48 to 200, particularly preferably 70 to 200). In the case where the number of filaments in the non-crimped yarn is less than 48, the water-pressure resistance of the woven fabric may be impaired.

In addition, it is preferable that the non-crimped yarn has a single-yarn fineness of 0.5 dtex or less (more preferably 0.001 to 0.5 dtex). Ultrafine fibers having a single-yarn fiber diameter of 1 μm or less, which are called nanofibers, may also be used. In the case where the non-crimped yarn has a single-yarn fineness of more than 0.5 dtex, the water-pressure resistance of the woven fabric may be impaired.

The single-fiber cross-sectional shape of the crimped yarn is not particularly limited and may be a known cross-sectional shape, such as round, triangular, flat, or hollow.

The fiber that forms the non-crimped yarn is not particularly limited. However, in order to obtain excellent water-pressure resistance, polyester fibers are preferable. Preferred examples of polyester polymers forming such polyester fibers include polyethylene terephthalate, polytrimethylene terephthalate, polybutylene terephthalate, polylactic acid, stereocomplex polylactic acid, and polyesters copolymerized with a third component. The polyester may also be a polyester obtained by material recycling or chemical recycling or polyethylene terephthalate obtained using a monomer component produced from a biomass raw material, that is, a substance of biological origin, as described in JP-A-2009-091694. Further, it may also be a polyester obtained using a catalyst containing a specific phosphorus compound or titanium compound as described in JP-A-2004-270097 or JP-A-2004-211268. The polyester polymer may also contain one or more kinds of delusterants (titanium dioxide), micropore-forming agents, cationic dye dyeable agents, coloring inhibitors, heat stabilizers, fluorescent brighteners, colorants, moisture absorbents, and inorganic fine particles.

In the woven fabric of the invention, one of the warp and weft contains a false-twist crimped yarn, and the other contains a non-crimped yarn. It is particularly preferable that one of the warp and weft contains only a false-twist crimped yarn, and the other contains only a non-crimped yarn. In the case where both the warp and weft are made only of a false-twist crimped yarn, sufficient water-pressure resistance is not obtained, and this is thus undesirable. In addition, in the case where both the warp and weft are made only of a non-crimped yarn, sufficient water-pressure resistance is not obtained, and this is thus undesirable.

Examples of embodiments of the invention include Embodiment 1 in which the warp contains a false-twist crimped yarn, while the weft contains a non-crimped yarn, and Embodiment 2 in which the warp contains a non-crimped yarn, while the weft contains a false-twist crimped yarn.

In particular, it is preferable to use a false-twist crimped yarn as the warp. This is because as compared with a non-crimped yarn, a false-twist crimped yarn can reduce heald abrasion in the weaving process. In addition, it is preferable to use a non-crimped yarn as the weft. This is because as compared with a false-twist crimped yarn, a non-crimped yarn provides the weft with excellent running properties and thus leads to improved weaving efficiency. For this reason, Embodiment 1 in which the warp contains a false-twist crimped yarn, while the weft contains a non-crimped yarn, is preferable.

Incidentally, the warp and/or weft may also contain other fibers in an amount of 40 wt % or less (more preferably 20 wt % or less, most preferably 0 wt %) of its total weight. That is, in the case where the warp contains a false-twist crimped yarn and the weft contains a non-crimped yarn, the warp may also contain a non-crimped yarn in an amount of 40 wt % or less of the warp total weight. Similarly, in the case where the warp contains a false-twist crimped yarn and the weft contains a non-crimped yarn, the weft may also contain a false-twist crimped yarn in an amount of 40 wt % or less of the warp total weight and in an amount of 40 wt % or less of the weft total weight.

Due to the synergetic effect of the swelling of the false-twist crimped yarn and the binding force of the non-crimped yarn, the woven fabric of the invention has excellent light-weightness (low areal weight) and excellent water-pressure resistance.

In this case, the non-crimped yarn serves to bind the weave points in the woven fabric structure; therefore, the lower the total fineness, the better. In addition, in the case where the total fineness of the false-twist crimped yarn is equal to or higher than the total fineness of the non-crimped yarn, this provides particularly excellent water-pressure resistance and thus is preferable.

In the woven fabric of the invention, the woven fabric structure of the woven fabric is not limited. Examples thereof include three foundation weaves including plain weave, twill weave, and satin weave, modified weaves, modified weaves such as modified twill weave, one-side backed weaves such as warp-backed weave and weft-backed weave, and warp velvet. In particular, in order to obtain excellent water-pressure resistance, plain weave (taffeta) and ripstop weave (e.g., weave in which the ground weave is plain and which has a lattice pattern formed such that the distance between the centers of adjacent rips is about 4 to 8 mm), which have a large number of weave points where the warp and weft intersect, are preferable. In particular, use of ripstop weave improves not only the water-pressure resistance but also the tear strength of the woven fabric, and thus is preferable. With respect to the number of layers, it may be single-layered and may also be multilayered including two or more layers. In addition, the weaving method may be an ordinary method using an ordinary weaving machine (e.g., an ordinary water jet loom, air jet loom, rapier loom, etc.).

The woven fabric of the invention can be produced by the following production method, for example. First, a false-twist crimped yarn is prepared for the warp, and a non-crimped yarn is prepared for the weft. Alternatively, a non-crimped yarn is prepared for the warp, and a false-twist crimped yarn is prepared for the weft. Next, they are formed into a woven fabric having an areal weight of 100 g/m$^2$ or less and a cover factor of 1,800 or more. The woven fabric of the invention can thus be produced.

Here, it is preferable that the woven fabric is subjected to calendering or water-repellent processing (preferably calendering and water-repellent processing) because the space in the weave formed by the warp and weft is thus reduced, whereby water-pressure resistance is further improved. In this case, for water-repellent processing, the method described in Japanese Patent No. 3133227 or JP-B-4-5786, for example, is suitable. That is, according to the method, a processing agent having a water-repellent agent concentration of about 3 to 15 wt % is prepared using a commercially available fluorine-based water-repellent agent (e.g., Asahi Guard LS-317 manufactured by Asahi Glass) as a water-repellent agent optionally together with melamine resin or a catalyst, and the surface of a woven fabric is treated with the processing agent at a pick-up rate of about 50 to 90%. The method for treating the surface of a woven fabric with the processing agent may be a padding method, a spray method, or the like, for example. In particular, in order for the processing agent to penetrate into the woven fabric, a padding method is the most preferable. Incidentally, the pick-up rate is the weight percentage (%) of the processing agent to the weight of the woven fabric (before the application of the processing agent). In addition, the conditions for calendering are preferably such that the temperature is 130° C. or more (more preferably 140 to 195° C.) and the linear load is within a range of 200 to 20,000 N/cm.

In the invention, the woven fabric may additionally be subjected to ordinary dyeing and finishing processing, weight reduction processing, napping processing; any of various processes imparting a function of a UV shielding or antistatic agent, an antibacterial agent, a deodorant, an insect repellent, a phosphorescent agent, a retroreflective agent, a minus ion generator, etc.; or buffing processing or brushing processing.

The woven fabric thus obtained has excellent lightweightness and water resistance due to the synergetic effect of the swelling of the false-twist crimped yarn and the binding force of the non-crimped yarn that binds the false-twist crimped yarn. In the case where both the warp and weft are false-twist crimped yarns, although this leads to the excellent swelling of the yarns forming the woven fabric, the binding force in the woven fabric structure (intersections of warp and weft) may be weak, whereby sufficient water-pressure resistance may not be obtained. Meanwhile, in the case where both the warp and weft are non-crimped yarns, although the binding force in the woven fabric structure is strong, the swelling of the yarns forming the woven fabric may be small, whereby sufficient water-pressure resistance may not be obtained.

It is preferable that the woven fabric of the invention has a water-pressure resistance of 800 mm or more (more preferably 860 to 2,000 mm) as measured by the low water pressure method (hydrostatic pressure method) described in JIS L1092. It is particularly preferable that the water-pressure resistance retention after 20 washes as specified in JIS L1018-77, Method 6.36H, is 70% or more (more preferably 70 to 95%). Water-pressure resistance retention is defined by the following equation.

Water-pressure resistance retention (%)=(water-pressure resistance after washing)/(water-pressure resistance before washing)×100

In addition, as the tear strength of the woven fabric, it is preferable that the average of five measurements on each of the warp and weft in accordance with JIS L1079 A1 (single tongue method) is 7 N or more (more preferably 7 to 40 N). Incidentally, such tear strength can be obtained by employing the ripstop weave mentioned above as the woven fabric structure, for example.

Further, it is preferable that such a woven fabric has a water repellency of level 5 as measured in accordance with JIS L 1092, Water Repellency (spray method). Incidentally, level 5 is the highest level of water repellency.

Next, the garment of the invention is a garment using the woven fabric. The garment uses the woven fabric and thus has excellent lightweightness and water resistance. Incidentally, such garments include sports clothing such as windbreakers, golf clothes, running clothes, and tennis clothes, outdoor clothing such as rainwear and down garments, men's garments, women's garments, working clothes, and general garments. Incidentally, the woven fabric may also be used as a textile product such as a curtain, a tent, a tape, an umbrella fabric, a hat, a shading sheet, a shading net, a sleeping bag cover, or a bedding cover.

EXAMPLES

Next, examples of the invention and comparative examples will be described in detail, but the invention is not limited thereto. Incidentally, measurement items in the Examples were measured by the following methods.

(1) Areal Weight of Woven Fabric

Measurement was performed in accordance with JIS L1096 6.4.2.

(2) Thickness of Woven Fabric

Measurement was performed in accordance with JIS L1096 6.5.

(3) Cover Factor of Woven Fabric

The cover factor of a woven fabric was determined by the following equation CF:

$$CF=(DWp/1.1)^{1/2}\times MWp+(DWf/1.1)^{1/2}\times MWf$$

wherein DWp is the total fineness of the warp (dtex), MWp is the weaving density of the warp (yarns/2.54 cm), DWf is the total fineness of the weft (dtex), and MWf is the weaving density of the weft (yarns/2.54 cm).

(4) Crimp Degree

A test yarn was wound around a sizing reel having a perimeter of 1.125 m to prepare a skein having a dry fineness of 3,333 dtex. The skein was hung on a hanger nail of a scale plate. An initial load of 6 g was applied to the lower part thereof, and a further load of 600 g was applied. The resulting skein length L0 was measured. The load was then immediately removed from the skein, and the skein was removed from the hanger nail of the scale plate and immersed in boiling water for 30 minutes, allowing crimps to be developed. The skein treated with boiling water was removed from boiling water, and moisture contained in the skein was removed by absorption on filter paper. The skein was then air-dried at room temperature for 24 hours. The air-dried skein was hung on a hanger nail of a scale plate. A load of 600 g was applied to the lower part thereof, and the skein length L1a was measured after 1 minute. The load was then removed from the skein, and the skein length L2a was measured after 1 minute. The crimp degree (CP) of the test filament yarn was calculated by the following equation.

$$CP(\%)=((L1a-L2a)\times/L0)\times 100$$

(5) Water-Pressure Resistance

A sample before washing and a sample after 20 washes as specified in JIS L1018-77, Method 6.36H, were measured for water-pressure resistance by the low water pressure method (hydrostatic pressure method) described in JIS L1092.

(6) Water Repellency

Measurement was performed in accordance with Water Repellency (spray method) described in JIS L 1092.

Example 1

Pellets obtained by the solid-state polymerization of polyethylene terephthalate at 230° C. for 6 hours were discharged at a spinning temperature of 290° C., followed by the application of an oil, and then once wound up at a spinning rate of 1,200 m/min to give an unstretched yarn having an intrinsic viscosity of 0.75. Subsequently, using an external-friction-disc-type false twisting machine as a false twisting machine, the unstretched yarn was false-twist textured at a disc circumferential speed/yarn speed ratio (D/Y) of 2.0 under the following conditions: the draw ratio between the heating roller and the take-up roller: 3.0, the circumferential speed of the take-up roller: 800 m/min, relaxation rate: 1.5%, the spindle rotation speed of the ring twisting machine 9: 7,500 rpm, the temperature of the heating roller: 90° C., the temperature of the heating heater: 260° C. (heater length: 130 mm), interlacing nozzle pneumatic pressure: 1.0 kg/cm$^2$ (9.8 N/cm$^2$). Thus, a false-twist crimped yarn of 44 dtex/144 fil having a crimp degree of 23% was obtained for the warp.

Meanwhile, polyethylene terephthalate was spun at a spinning temperature of 300° C., taken up at 4,000 m/min, and successively, without winding up, stretched to 1.3 times the original length. Thus, a polyester multifilament of 22 dtex/72 fil (non-crimped yarn), in which the transverse cross-sectional shape of the filaments was round, was obtained for the weft.

Subsequently, using an ordinary water jet loom (weaving machine), the warp and weft were formed into a woven fabric having the ripstop weave shown in FIG. 1 (weave in which the ground weave is plain and which has a rip lattice pattern formed such that the distance between the centers of adjacent rips is 6 mm). The woven fabric had a warp density of 220 yarns/2.54 cm and a weft density of 150 yarns/2.54 cm.

The woven fabric was then subjected to ordinary dyeing and finishing processing and water-repellent processing, followed by final setting and calendering to give a densely woven fabric. The water-repellent processing was performed using the following processing agent, and the woven fabric was mangled at a pick-up rate of 70%, dried at a temperature of 130° C. for 3 minutes, and then heat-treated at a temperature of 170° C. for 45 seconds. The calendering was performed at a roll temperature of 160° C.

<Processing Agent Composition>

Fluorine-based water-repellent agent: 10.0 wt % (Asahi Guard LS-317, manufactured by Asahi Glass)

Melamine resin: 0.3 wt % (SUMITEX Resin M-3, manufactured by Sumitomo Chemical)

Catalyst: 0.3 wt % (SUMITEX Accelerator ACX, manufactured by Sumitomo Chemical)

Water: 89.4 wt %

Table 1 shows the results of the evaluation of the obtained woven fabric. The woven fabric had excellent lightweightness and water-pressure resistance.

Next, a windbreaker and a down garment were obtained using the woven fabric and worn. As a result, they both had excellent lightweightness and water-pressure resistance.

Example 2

The same procedure as in Example 1 was performed, except that a woven fabric having a warp density of 220 yarns/2.54 cm and a weft density of 115 yarns/2.54 cm was formed using a polyethylene terephthalate multifilament of 35 dtex/72 fil (non-crimped yarn), in which the transverse cross-sectional shape of the filaments was round, as the weft.

Table 1 shows the results of the evaluation of the obtained woven fabric. The woven fabric had excellent lightweightness and water-pressure resistance.

Example 3

The same procedure as in Example 1 was performed, except that a woven fabric having a warp density of 220 yarns/2.54 cm and a weft density of 77 yarns/2.54 cm was formed using a polyethylene terephthalate multifilament of 84 dtex/72 fil (non-crimped yarn), in which the transverse cross-sectional shape of the filaments was round, as the weft.

Table 1 shows the results of the evaluation of the obtained woven fabric. The woven fabric had excellent lightweightness and water-pressure resistance.

Comparative Example 1

The same procedure as in Example 1 was performed, except that a polyethylene terephthalate multifilament of 44 dtex/144 fil (non-crimped yarn), in which the transverse cross-sectional shape of the filaments was round, was used as the warp.

Table 1 shows the results of the evaluation of the obtained woven fabric. The woven fabric had poor water-pressure resistance.

Comparative Example 2

The same procedure as in Example 1 was performed, except that a woven fabric having a warp density of 171 yarns/2.54 cm and a weft density of 116 yarns/2.54 cm was formed.

Table 1 shows the results of the evaluation of the obtained woven fabric. The woven fabric had a small cover factor and thus had poor water-pressure resistance.

Comparative Example 3

The same procedure as in Example 1 was performed, except that a polyethylene terephthalate false-twist crimped yarn of 22 dtex/72 fil having a crimp degree of 23% was used as the weft.

Table 1 shows the results of the evaluation of the obtained woven fabric. The binding force in the woven fabric structure was weak, and thus the woven fabric had poor water-pressure resistance.

TABLE 1

| | | Example 1 | Example 2 | Example 3 | Comparative Example 1 | Comparative Example 2 | Comparative Example 3 |
|---|---|---|---|---|---|---|---|
| Total Fineness (dtex) | Warp | 44 | 44 | 44 | 44 | 44 | 44 |
| | Weft | 22 | 35 | 84 | 22 | 22 | 22 |
| Number of Filaments | Warp | 144 | 144 | 144 | 144 | 144 | 144 |
| | Weft | 72 | 72 | 72 | 72 | 72 | 72 |
| Kind of Yarn | Warp | False-twist crimped yarn | False-twist crimped yarn | False-twist crimped yarn | Non-crimped yarn | False-twist crimped yarn | False-twist crimped yarn |
| | Weft | Non-crimped yarn | Non-crimped yarn | Non-crimped yarn | Non-crimped yarn | Non-crimped yarn | False-twist crimped yarn |
| Density (yarns/2.54 cm) | Warp | 220 | 220 | 220 | 220 | 171 | 220 |
| | Weft | 150 | 115 | 77 | 150 | 116 | 150 |
| Cover Factor | | 2,062 | 2,042 | 2,058 | 2,062 | 1,600 | 2,062 |
| Weave | | Ripstop | Ripstop | Ripstop | Ripstop | Ripstop | Ripstop |
| Thickness (mm) | | 0.08 | 0.08 | 0.08 | 0.08 | 0.07 | 0.08 |
| Areal Weight (g/m$^2$) | | 76 | 80 | 82 | 77 | 60 | 76 |
| Water Repellency (level) | | 5 | 5 | 5 | 5 | 5 | 5 |
| Water-Pressure Resistance (mm) | Initial | 900 | 870 | 870 | 850 | 500 | 840 |
| | After 20 washes | 800 | 810 | 800 | 500 | 300 | 500 |

INDUSTRIAL APPLICABILITY

The invention provides a woven fabric having excellent lightweightness and water resistance and a garment using the woven fabric. Thus, the industrial value of the invention is extremely high.

The invention claimed is:

1. A woven fabric having an areal weight of 70 to 100 g/m$^2$ and a cover factor of 1,800 or more, characterized in that one of the warp and weft of the woven fabric contains a false-twist crimped yarn, and the other contains a non-crimped yarn, and the false-twist crimped yarn has a single-yarn fineness of 0.5 dtex or less, the false-twist crimped yarn has a crimp degree of 23 to 35%, and the non-crimped yarn has a single-yarn fineness of 0.5 dtex or less and the false-twist crimped yarn has 120 to 10000 filaments, and both the false-twist crimped yarn and the non-crimped yarn have a total fineness of 10 to 50 dtex, and the woven fabric has a water repellency level of 5 measured according to water repellency spray method described in JIS L 1092, and the woven fabric has been subjected to calendering, and the woven fabric contains the false-twist crimped yarn as one component of a composite yarn having a torque of 50 T/m or less, and the thickness of the woven fabric is 0.1 mm or less, and the total fineness of the false-twist crimped yarn is equal to or higher than the total fineness of the non-crimped yarn, wherein the crimp degree is measured by a method in which a test yarn is wound around a sizing reel having a perimeter of 1.125 m to prepare a skein having a dry fineness of 3,333 dtex and the skein is hung on a hanger nail of a scale plate and an initial load of 6 g is applied to the lower part thereof, and a further load of 600 g is applied and the resulting skein length L0 is measured and the load is then immediately removed from the skein, and the skein is removed from the hanger nail of the scale plate and immersed in boiling water for 30 minutes, allowing crimps to be developed, and the skein treated with boiling water is removed from boiling water, and moisture contained in the skein is removed by absorption on filter paper, and the skein is then air-dried at room temperature for 24 hours and the air-dried skein is hung on a hanger nail of a scale plate and a load of 600 g is applied to the lower part thereof, and the skein length L1a is measured after 1 minute and the load is then removed from the skein, and the skein length L2a is measured after 1 minute and the crimp degree (CP) of the test filament yarn is calculated by the following equation:

$$CP(\%)=((L1A-L2a)/L0)\times 100,$$

wherein the water pressure resistance of the woven fabric is 800 mm or more, wherein the water-pressure resistance is measured by the low water pressure method (hydrostatic pressure method) described in JIS L1092, wherein the water-pressure resistance retention after 20 washes of the woven fabric is 70% or more, wherein the water-pressure resistance retention after 20 washes is as specified in JIS L1018-77, Method 6.36H, wherein water-pressure resistance retention is defined by the following equation:

Water-pressure resistance retention (%) =(water-pressure resistance after washing)/(water-pressure resistance before washing)×100.

2. The woven fabric according to claim 1, wherein at least one of the false-twist crimped yarn and the non-crimped yarn is made of a polyester fiber.

3. A garment comprising the woven fabric according to claim 2.

4. The woven fabric according to claim 1, wherein the woven fabric has been subjected to water-repellent processing.

5. A garment comprising the woven fabric according to claim 4.

6. A garment comprising the woven fabric according to claim 1.

7. The woven fabric according to claim 1, wherein the total fineness of the false-twist crimped yarn is higher than the total fineness of the non-crimped yarn.

* * * * *